US006616267B2

(12) United States Patent
Weijkamp

(10) Patent No.: US 6,616,267 B2
(45) Date of Patent: Sep. 9, 2003

(54) INK JET COLOR PRINTING METHOD AND PRINTER

(75) Inventor: Clemens Theodorus Weijkamp, Zijtaart (NL)

(73) Assignee: Oce-Technologies B.V., MA Venlo (NL)

( * ) Notice: Subject to any disclaimer, the term of this patent is extended or adjusted under 35 U.S.C. 154(b) by 0 days.

(21) Appl. No.: 09/989,424

(22) Filed: Nov. 21, 2001

(65) Prior Publication Data

US 2002/0060717 A1 May 23, 2002

(30) Foreign Application Priority Data

Nov. 23, 2000 (EP) ..... 00204159

(51) Int. Cl.[7] ..... B41J 2/21
(52) U.S. Cl. ..... 347/43; 347/41
(58) Field of Search ..... 347/43, 15, 16, 347/12, 40, 41

(56) References Cited

U.S. PATENT DOCUMENTS 4,528,576 A 7/1985 Koumura et al.
6,302,508 B1 10/2001 Asauchi et al. ..... 347/15
6,315,387 B1 11/2001 Horikoshi ..... 347/40

FOREIGN PATENT DOCUMENTS

| | | |
|---|---|---|
| EP | 0 955 174 A | 11/1999 |
| EP | A 0 955 174 | 11/1999 |
| EP | 1 088 670 A | 4/2001 |
| JP | 52-215351 | 12/1983 |
| JP | 58 215 351 A | 3/1984 |

*Primary Examiner*—Lamson Nguyen
(74) *Attorney, Agent, or Firm*—Birch, Stewart, Kolasch & Birch, LLP

(57) ABSTRACT

A method of color printing with an ink jet printer having a printhead which is reciprocatingly moved in forward and return scan passes in a main scanning direction, in which an even number of nozzle arrays is provided for each of at least two colors, and said nozzle arrays are symmetrically arranged in the main scanning direction, wherein, for printing a single pixel composed of at least two colors with high density, ink dots of each of these colors are formed in even numbers by activating the corresponding nozzles of the symmetrically arranged arrays at appropriate timings in the same scan pass of the printhead.

7 Claims, 4 Drawing Sheets

INK JET COLOR PRINTING METHOD AND PRINTER

BACKGROUND OF THE INVENTION

The present invention relates to a method of color printing with an ink jet printer having a printhead which reciprocatingly moves in forward and return scan passes in a main scanning direction, in which an even number of nozzle arrays is provided for each of at least two colors, and the nozzle arrays are symmetrically arranged in the main scanning direction. The present invention further relates to an ink jet printer for carrying out this method.

The printhead of an ink jet color printer typically has at least one nozzle array for each color. For example, in three-color printing, three nozzle arrays will be provided for the colors cyan (C), magenta (M) and yellow (Y). Each nozzle array comprises a plurality of nozzles which, in case of a linear array, for example, are arranged equidistantly on a line that extends in a direction orthogonal to the main scanning direction. The distance between neighboring nozzles corresponds to the distance between adjacent pixels of the image to be printed, so that the number of pixel lines that can be printed in one scan pass corresponds to the number of nozzles in the array. The nozzle arrays for the various colors are sequentially arranged in the main scanning direction, for example in the order C-M-Y. In order to print a pixel that is composed of several colors, the corresponding nozzles of the various arrays are energized at appropriate timings, so that ink droplets jetted out from the various nozzles impinge on the recording sheet essentially at the same location, i.e. the location of the pixel to be printed. Thus, the ink droplets of different colors composing the pixel will be superposed one upon the other or will at least overlap with each other. During a forward scan pass of the printhead, the ink droplets of different colors will be superposed on the recording sheet in the order C-M-Y, and during a return stroke or scan pass of the printhead, the ink droplets will be superposed in reverse order.

It has been found however that the order in which the ink droplets are superposed one upon the other has an influence on the hue of the printed pixel. This effect is particularly marked for green colors composed of cyan and yellow ink. When a cyan droplet is superposed on a yellow droplet and both droplets have the same volume, then the cyan component forming the top layer will be predominant and the hue of the printed green pixel will be shifted to the blue side of the spectrum. Conversely, when the yellow droplet is superposed on the cyan one, then the hue will be shifted to the yellow side. As a result, when a solid green area is to be printed, the shifts in the hue will be visible to the human eye in the form of bands extending in the main scanning direction and having a width corresponding to the height of the nozzle arrays.

In order to eliminate this undesirable artefact, U.S. Pat. No. 4,528,576 discloses a printing method in which two nozzle arrays are provided for each color, and the nozzle arrays are symmetrically arranged in the main scanning direction, for example in the nested sequence C-M-Y-Y-M-C. When the nozzle head moves in forward direction, only the first three nozzle arrays are used, so that the colors are superposed in the order C-M-Y. In the return scan pass of the printhead, the other three nozzles heads are used, so that the colors are again superposed in the same order. This avoids the creation of bands with different hue but has the disadvantage that the nozzle arrays are utilized quite inefficiently, because only one half of the total number of nozzle arrays is used in each scan pass.

SUMMARY OF THE INVENTION

It is an object of the present invention to provide an ink jet color printing method and printer in which the hue of the printed colors does not depend on the direction of the scan pass and which at the same time permit high resolution and high density printing with efficient use of the nozzle arrays.

According to the present invention, this object is achieved by a method, in which, for printing a single pixel composed of at least two colors with high density, ink dots of each of these colors are formed in even numbers by activating the corresponding nozzles of the symmetrically arranged arrays at appropriate timings in the same scan pass of the printhead.

Thus, if a green pixel is to be printed, for example, then the pixel will be composed of at least four ink droplets two of which are formed by yellow ink and the other two of which are formed by cyan ink. The order in which these ink droplets are printed and superposed will, for example, be C-Y-Y-C, irrespective of the direction of the scan pass.

This method has the advantage that it permits a high printing resolution without degrading the image density of the printed image.

It is generally known that, when the printing resolution of an ink jet printer is increased, the volume of the ink droplet becomes so small that the density of the image may become insufficient. This can be understood from the following simplified consideration. As has been mentioned above, the size of the pixels to be printed, and hence the printing resolution, is determined by the pitch of the nozzles in the array. Each nozzle is connected to an ink channel or cavity in which the ink liquid is pressurized by means of a piezoelectric actuator or the like. Thus, the space available for the various cavities is limited by the pitch of nozzles. Further, the cross section of the nozzle orifice must be smaller than the cross section of the cavity in order to achieve a nozzle action which is necessary for forming the ink droplets. As a result, the maximum diameter of the nozzle orifice is roughly proportional to the pitch of the nozzles. If the printing resolution is to be increased by a certain factor r, then, roughly speaking, the whole nozzle array should be scaled down by the factor 1/r. The diameter of the ink droplet expelled from the nozzle is roughly proportional to the diameter of the nozzle orifice, so that the volume of the ink droplets will be decreased by a factor 1/r3. However, the surface area of the pixels to be printed will be decreased only by the factor 1/r2, so that the image density, i.e. the ink volume per unit surface area will decrease approximately with 1/r.

It is generally known that this decrease of the image density can be compensated for by employing a multi-pass system in which, even in a single color printer, a pixel to be printed is composed of two or more ink droplets which are generated in successive scan passes.

The present invention combines this principle for improving the image density with the known method of eliminating shifts of the hue in color printing and thereby makes more efficient use of the nozzle arrays which anyway must be provided at least two-fold for each color.

In a preferred embodiment, the printhead comprises two nozzle arrays for each color, and the nozzle arrays are arranged in two blocks, so that each block comprises a complete set of nozzle arrays for each color, and one block is the mirror image of the other.

Preferably, the nozzle blocks themselves are mirror-symmetric with respect to a median plane which intersects the linear nozzle arrays at right angles. Then, the two nozzle blocks may have an identical construction and may be manufactured in exactly the same procedure, and when the blocks are mounted to the printhead, one of them is mounted in an orientation rotated by 180°. This increases not only the production efficiency but has the further advantage that the effect of certain defects of the nozzle arrays may be mitigated. Such defects may, for example, consist of a slight misalignment of the nozzles within the nozzle arrays or of minor defects of the nozzle orifices which cause the ink droplets to be jetted out not exactly along the axis of the nozzle but under a slight screw angle. When the two nozzle blocks are obtained in the same production process, these defects will be essentially the same for both blocks, and when the two blocks are mounted on the printhead in mutually opposite orientation, the dot misplacements caused by these defects in the one nozzle block will be opposite to those caused in the other nozzle block, and by superposing these dots, the dot misplacements will be smoothened out.

In one embodiment, the individual pixels will be formed by exactly superposing the color dots one upon the other. In a modified embodiment, it is possible, however, to create elongated pixels by providing a slight offset between the first and the second dot of the same color, so that these dots still overlap but are not exactly congruent. As a result, the printing resolution will be unisotropic, which may be beneficial in certain applications as a compromise between the highest possible printing speed and reproduction of sufficient details of the printed image.

The offset between the dots may be either in the main scanning direction or in sub-scanning direction. In both cases, the offset can be brought about by a corresponding physical offset of the two nozzle blocks. If the offset is in the main scanning direction, it may alternatively be brought about by a corresponding shift between the timings at which the nozzles of the two blocks are energized.

With elongated pixels, it is also possible to operate the printer in a mode in which the two nozzle blocks are controlled independently from one another, so that the resolution in longitudinal direction of the pixels is increased.

BRIEF DESCRIPTION OF THE DRAWINGS

Preferred embodiments of the invention will now be described in conjunction with the accompanying drawings, in which.

DETAILED DESCRIPTION OF THE INVENTION

Figure 1:
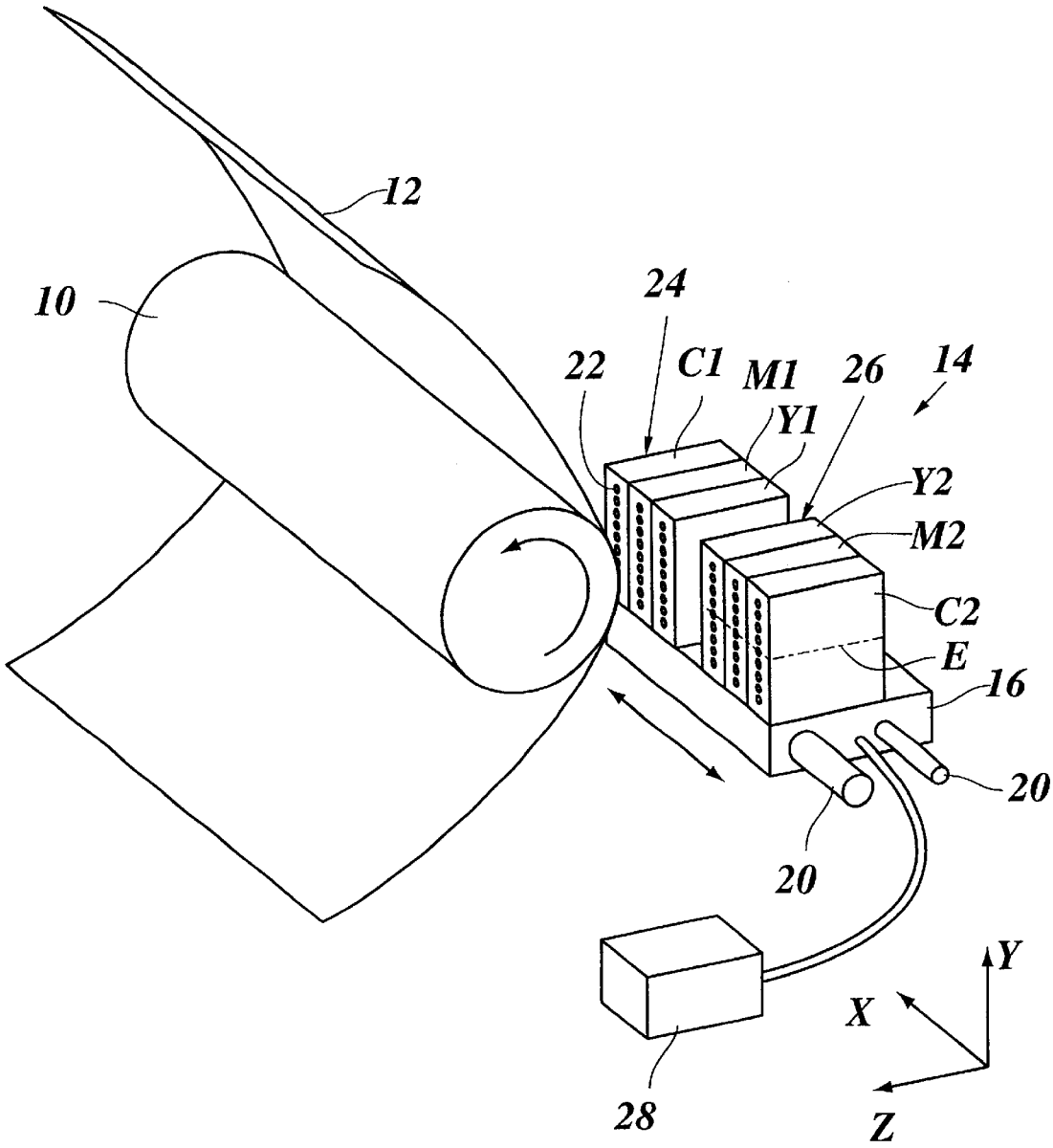
FIG. 1 is a schematic perspective view of an ink jet color printer according to the present invention.

As is shown in FIG. 1, an ink jet color printer comprises a platen 10 on which a recording sheet 12 is advanced in a sub-scanning direction Y. A printhead 14 is moved back and forth along the platen 10 in a main scanning direction X and comprises a carriage 16 mounted on guide bares 18, 20 for carrying a number of nozzle arrays C1, M1, Y1, Y2, M2 and C2 which are arranged in that order in the main-scanning direction X. Each nozzle array comprises a number N of nozzles 22 which, in the example shown, are arranged on a single straight line extending in the sub-scanning direction Y. The pitch of the nozzles 22, i.e. the vertical distance of neighboring nozzles, corresponds to the height of the pixels to be printed on the recording sheet 12. These pixels are printed by ejecting droplets of colored ink from the nozzles 22 in a direction Z normal to the plane of the recording sheet 12 where it faces the printhead. As is well known in the art, the droplets may be generated, for example, by means of thermal actuators (bubble-jet) or by means of piezoelectric actuators.

When the printhead 14 makes a forward scan pass in the +X-direction, a number N of image lines is printed simultaneously on the recording sheet 12. Then, the recording sheet 12 is advanced by a distance corresponding to the height of the nozzle arrays, and another N lines are printed during the return scan pass of the printhead 14.

The nozzle arrays are arranged in two blocks 24, 26, and each of these blocks comprises three nozzle arrays, one for each of the basic colors cyan, magenta and yellow. The reference signs for the nozzle arrays indicate the color of the ink: C1 and C2 stand for the color "cyan", M1 and M2 stand for the color "magenta" and Y1 and Y2 stand for the color "yellow". The two blocks 24 and 26 have an identical construction and are mirror-symmetric with respect to a median plane E which is parallel to the X-Z plane. Compared to the block 24, the block 26 is mounted on the carriage 16 "top down" so that the order of colors in the block 26 is the mirror image of the order of colors in the block 24.

The printhead 14 is connected to a control unit 28 which controls the actuators for the various nozzles 22 in accordance with the image information of the image to be printed.

The operation of the printer according to a first embodiment of the present invention will now be described in conjunction with FIGS. 2A–D. In these figures, a part of the recording sheet 12 is shown in cross-section, and the position of a pixel P to be printed is indicated by a rectangle within the cross-section of the recording sheet 12.

In FIGS. 2A to 2D, the printhead 14 makes a forward scan pass in the +X-direction. It is assumed that the color of the pixel P to be printed shall be green, i.e. the pixel is to be composed of cyan and yellow color components.

Figure 2A:
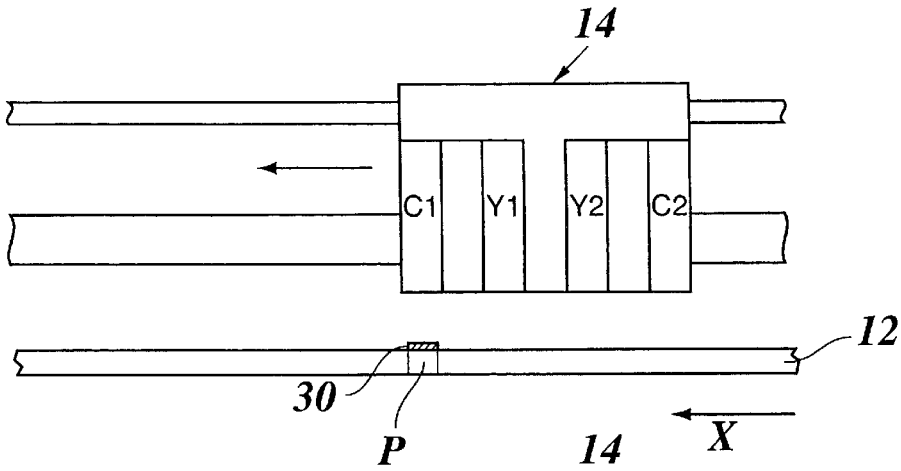
FIGS. 2A–D are schematic top plan views of the printer shown in FIG. 1, illustrating the formation of a color pixel during one scan pass of the printhead.
Figure 2B:
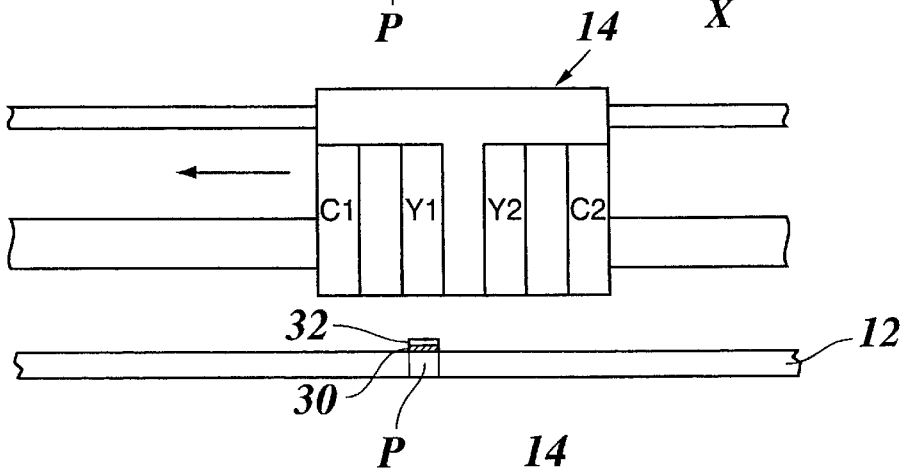

FIG. 2A illustrates the situation in which the first cyan nozzle array C1 of the printhead has reached the position of the pixel P, and a first cyan dot 30 has been formed on the recording sheet. In FIG. 2B, the first yellow nozzle array Y1 has reached the position of the pixel P, and a first yellow dot 32 has been formed on top of the dot 30, so that the color of the pixel P becomes the mixed color "green". However, since the volume of the ink droplets expelled from the nozzles 22 is relatively small, the color density of the dots 30, 32 is not sufficient to give a saturated green pixel, and thus, the resulting printed image looks faint.

Figure 2C:
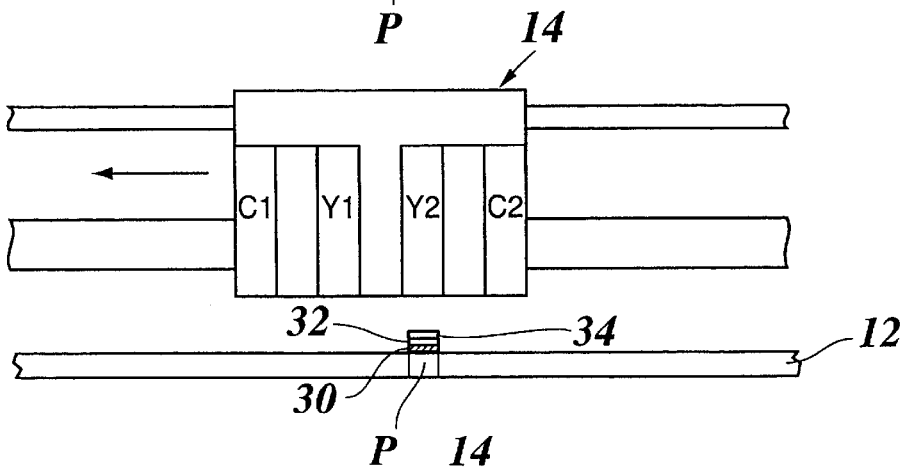

In FIG. 2C, the second yellow nozzle array Y2 has reached the position of the pixel P and a second yellow dot 34 is superposed on the dot 32. Then, in FIG. 2D, another cyan dot 36 is superposed on top of the dot 34, so that a pixel P with the mixed color "green" and with a satisfactorily high image density is obtained.

Figure 2D:
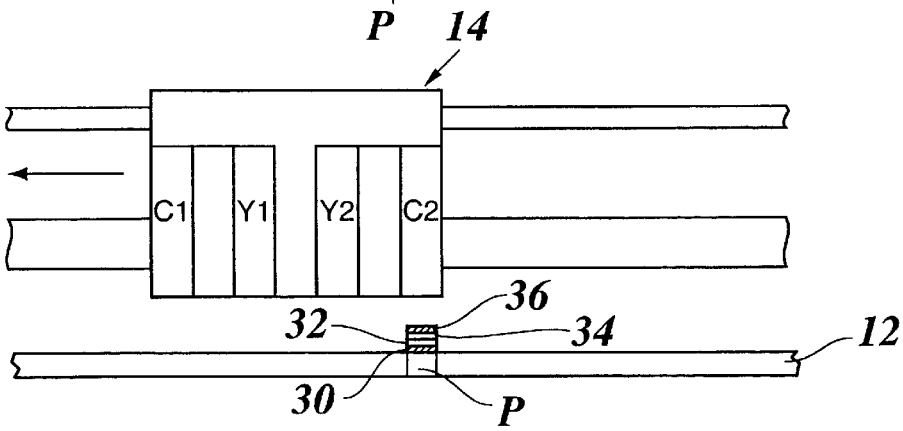

As is shown in FIG. 2D, the pixel P has a symmetric layer structure with the bottom layer and the top layer being formed by cyan ink and the two innermost layers being formed by yellow ink. It will be understood that the thickness of the layers as well as the thickness of the recording sheet 12 are grossly exaggerated in the drawing. In practice, the ink layers formed successively by the nozzle arrays C1, Y1, Y2 and C2 will not be strictly separated from one another, because the ink will not have completely dried-out when it is deposited on the recording sheet 12. However, since the mixing of the ink is not complete, the hue or color impression visible to the human eye is influenced by the order of the ink layers forming the pixel P. The symmetric order of the ink layers shown in FIG. 2D has the advantage that a good balance between the color components cyan and yellow is achieved. The main advantage, however, results from the fact that exactly the same order of ink layers is obtained when a green pixel P is printed in the return scan pass of the printhead 14. Then, the only difference would be that the nozzle arrays are energized in reverse order, i.e. C2-Y2-Y1-C1, but the order of colors would be the same. Thus, when a solid green surface area is to be printed on the recording sheet, the hue or color impression of this area will be uniform even if the height of the area is larger than the height of the nozzle arrays, and, accordingly, the area is composed of stripes printed alternatingly in forward and return scan passes.

It will be understood that the same holds true for other mixed colors formed by other combinations of the three basic color components.

The printhead 10 may comprise additional nozzle arrays for black ink, which have not been shown here for simplicity.

The invention is not limited to the case where a pixel P is formed by two dots of the same color. If the printing resolution is increased further and, accordingly, the volume of the ink droplets is decreased further, it may be possible to employ a printhead with four nozzle arrays for each color. Again, these arrays would be arranged such that the sequence of colors is mirror-symmetric.

Figure 5:
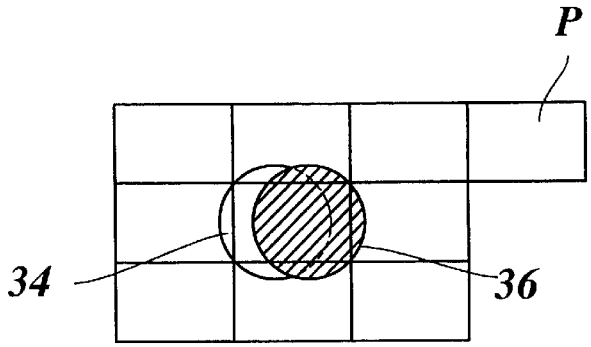
FIG. 5 is a pixel pattern illustrating the shape of partially overlapping color dots forming a pixel.

In the embodiment shown in FIGS. 2A–D it has been assumed that each pixel P has essentially the same dimensions in the main scanning direction X and the sub-scanning direction Y, so that the printed image would consist of a pattern of square pixels. FIGS. 3A–D and FIGS. 4A–D illustrate a modified embodiment, in which a pattern of elongated rectangular pixels is used, as is shown in FIG. 5. In this embodiment, the pixels P are elongated in the main scanning direction X, so that the printing resolution in the sub-scanning direction Y would be higher than in the main scanning direction. As is further shown in FIG. 5, the ink dots 34, 36 formed by individual ink droplets have an essentially circular shape, and the elongated shape of the pixel P is obtained by a slight offset of the dots 34, 36. In other words, the dots superposed one on the other are not exactly congruent, although at there is still a significant overlap between these dots.

As is further shown in FIG. 5, there is also a certain overlap of the dots 34, 36 with the neighboring pixels. This is necessary in order to be able to print solid areas without any voids between the adjacent pixels. In FIGS. 3A–D and 4A–D, however, this overlap from pixel to pixel has been neglected for simplicity.

FIGS. 3A–D and 4A–D illustrate the locations of four subsequent pixels P1, P2, P3 and P4 in the main scanning direction X, and it is assumed that a green line is to be printed which has a width in the X-direction of three pixel, but which is centered on the boarder line between the pixels P2 and P3. It may further be assumed that the ink dots printed with the nozzles of the block 24 are slightly offset from the center positions of the pixels in the −X-direction (to the right in FIG. 3), whereas the ink dots printed with the block 26 are offset in +X-direction. These offsets may be obtained either by the physical arrangement of the blocks 24, 26 on the carriage 16 or by a suitable time delay between the timings at which the nozzles of the two blocks are energized.

Figure 3A:
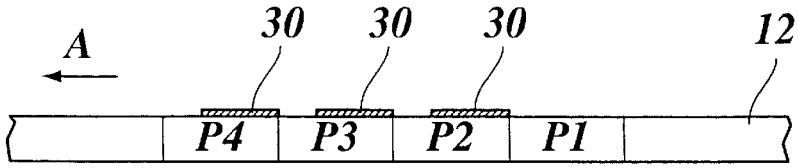
FIGS. 3A–D are schematic cross-sectional views of a recording sheet, illustrating a formation of pixels, that are elongated in the main scanning direction, during a forward scan pass of the printhead.
Figure 3B:
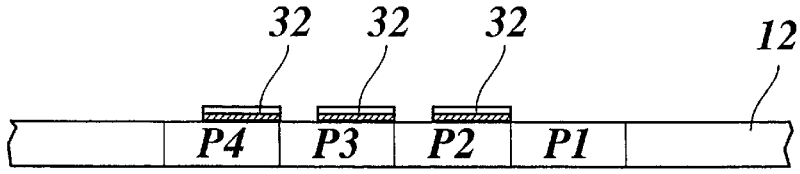

In FIGS. 3A–D, the printhead 14 moves in the +X-direction (to the left) in a forward scan pass. In FIG. 3A, the first cyan nozzle array C1 has passed over the pixels PI-P4 and has printed cyan dots 30 in each of the pixels P2, P3 and P4. In FIG. 3B, the first yellow nozzle array Y1 has passed over the pixels and has printed yellow dots 32 right on top of each of the dots 30. The nozzles of the block 24 are not energized for the pixel P1.

Figure 3C:
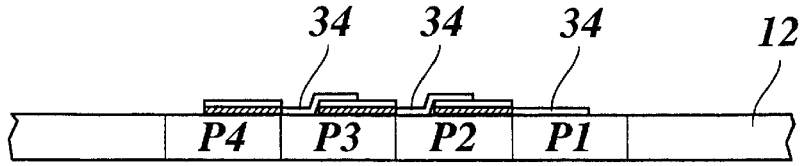
Figure 3D:
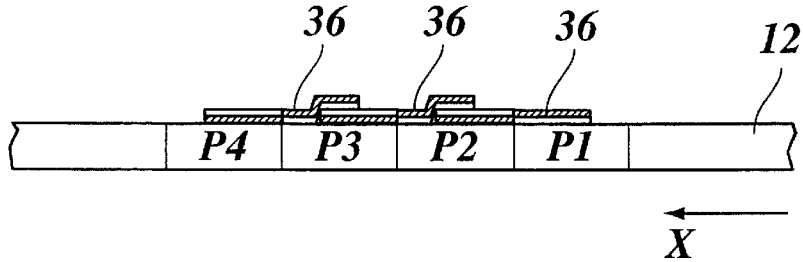
Figure 4A:
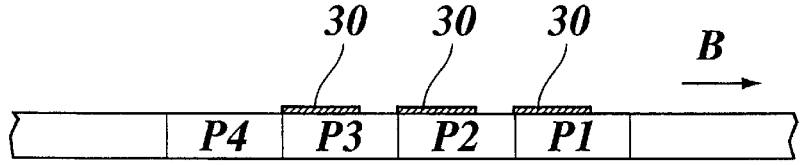
FIGS. 4A–D are cross-sectional views corresponding to FIGS. 3A–D and showing the formation of pixels during a return scan pass.
Figure 4B:
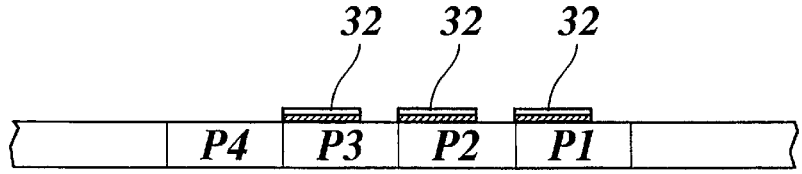
Figure 4C:
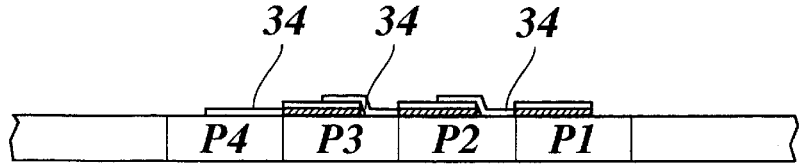
Figure 4D:
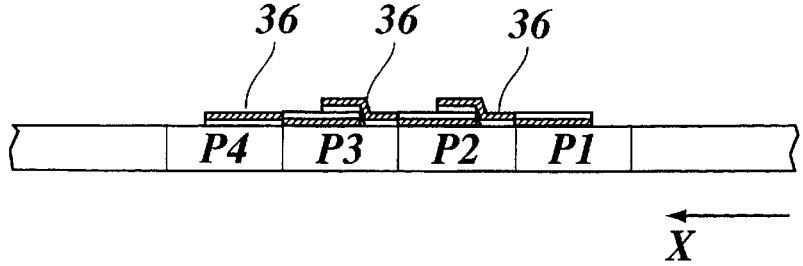

In FIG. 3C, the second yellow nozzle array Y2 has passed over the pixels and has been energized for printing the second yellow dot 34 in the pixels P1–P3 but not in the pixel P4. It will be observed that the dots 34 are shifted to the left end of the respective pixels. In FIG. 3D, the second cyan nozzle array C2 has passed over the pixels and has printed the top-layer cyan dots 36 in each of the pixels P1–P3.

As a result, the pixels P2 and P3 are formed by four partly overlapping color layers with symmetric color sequence. The pixels P1 and P4 are each formed by only two dots or color layers with mutually opposite color sequence, and these dots are placed directly adjacent to the pixels P2 and P3, respectively. The optical density of the pixels P1 and P4 is smaller than that of the pixels P2 and P3, and the overall impression will be that of a green line having a width of approximately 3 pixel. Thus, the offset of the dots formed by the nozzle blocks 24 and 26 is used to improve the printing resolution in the main scanning direction X.

FIGS. 4A–D illustrate the printing procedure for another section of the green line, which is printed during a return scan pass of the printhead. It can be seen that the arrangement of dots and the layer structure of the pixels in FIGS. 4A–D is just the mirror image of what is shown in FIGS. 3A–D. In the internal parts of the green line, i.e., in the pixels P2 and P3, the resulting hue or color impression will be the same in the forward and return scan passes, i.e. the hue is independent of the direction of the scan pass. A shift in hue occurs only for the pixels P1 and P4 which form the edge of the green line. However, since these shifts in hue are limited to less than one pixel in the direction normal to the edge, they are not perceptible to the human eye, and the formation of visible artifacts due to the opposite scan pass directions is prevented as in the first embodiment.

FIGS. 6A–D illustrate an embodiment in which the pixels P, Q are elongated in the sub-scanning direction Y. This may be achieved for example by an appropriate offset of the blocks 24, 26 in the sub-scanning direction. FIGS. 6A–D illustrate the process of printing a two-pixel wide green line which extends in the main scanning direction.

Figure 6A:
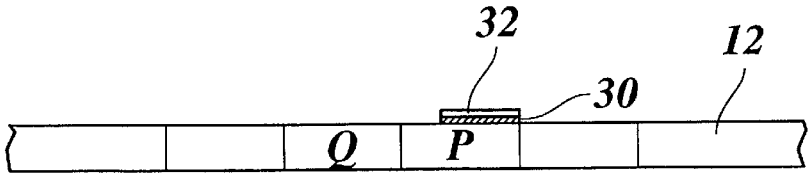
FIGS. 6A–D show longitudinal sections of the recording sheet and illustrate the formation of pixels that are elongated in the sub-scanning direction.
Figure 6B:
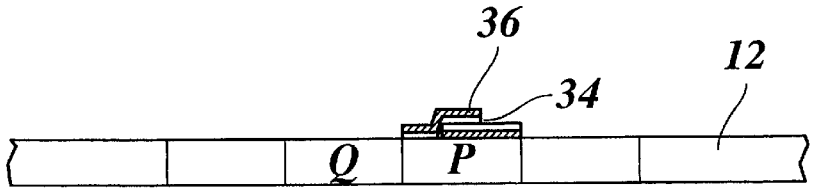

In FIG. 6A, the first cyan and yellow dots 30, 32 for the pixel P have been printed with the lowermost nozzles 22 of the nozzle arrays C1, Y1 of the block 24. In FIG. 6B, the second yellow and cyan dots 34, 36 have been printed with the block 26, and the forward scan pass has been completed.

Figure 6C:
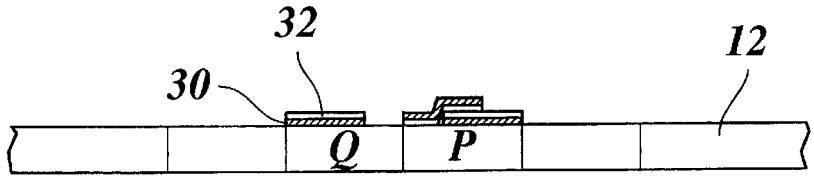
Figure 6D:
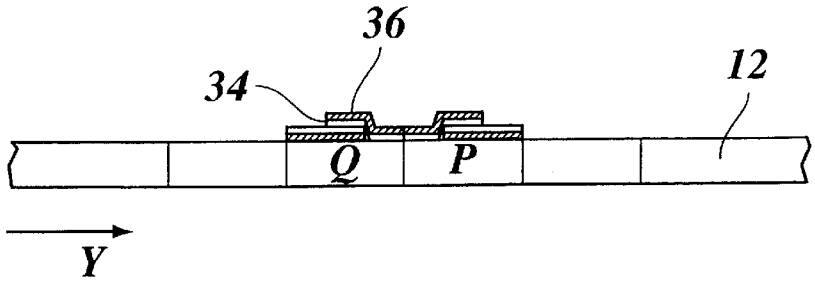

Then, the recording sheet 12 is advanced, so that the pixels Q of the next line can be printed with the uppermost nozzles 22 in the return scan pass. In FIG. 6C, the first cyan and yellow dots 30, 32 have been printed with the nozzle arrays C2, Y2 of the block 26 moving in –X-direction. Finally, in FIG. 6D, the second yellow and cyan dots 34, 36 for the pixel Q are printed with the block 24. It can be seen that the pixels Q and P in FIG. 6D have the same sequence of color layers and are mirror images of each other only with respect to the offset of the dots. This offset, however, does not have a noticeable influence of the color impression, so that no change in hue will be observed and the boarder between the image lines printed in the forward and return scan passes. Just as in the previous embodiment, it is possible in the embodiment shown in FIGS. 6A–D to improve the resolution (but this time in the sub-scanning direction Y) by printing "half pixels" with only the block 24 and only the block 26, respectively.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of color printing with an ink jet printer having a printhead which reciprocatingly moves in forward and return scan passes in a main scanning direction, in which an even number of nozzle arrays is provided for each of at least two colors, and said nozzles arrays are symmetrically arranged in the main scanning direction, wherein, for printing a single pixel composed of at least two colors with high density, ink dots of each of these colors are formed by printing an even number of ink droplets of each of these colors on the said single pixel by activating the corresponding nozzles of the symmetrically arranged arrays at appropriate timings in the same scan pass of the printhead.

2. The method according to claim 1, wherein ink dots of the same color and composing the same pixel are formed with substantial overlap but slightly offset in the main scanning direction.

3. The method according to claim 1, wherein ink dots of the same color and composing the same pixel are formed with substantial overlap but slightly offset in the sub-scanning direction.

4. An ink jet color printer comprising:

a printhead which is reciprocatingly moved in forward and return scan passes in a main scanning direction, in which an even number of nozzle arrays is provided for each of at least two colors, said nozzle arrays being symmetrically arranged in the main scanning direction, and a control unit for energizing nozzles of the nozzle arrays in accordance with the image information to be printed, wherein the control unit is arranged for activating the nozzles of the symmetrically arranged arrays at appropriate times such that, for printing a single pixel composed of at least two colors with high density, ink dots of each of these colors are formed in the same scan pass of the printhead by printing an even number of ink droplets of each of these colors on the said single pixel.

5. The ink jet printer according to claim 4, wherein the nozzle arrays are arranged in the main scanning direction in an even number of blocks, each block including one nozzle array of each color.

6. The ink jet printer according to claim 5, wherein the blocks have a substantial identical construction and are mirror-symmetric with respect to the median plane extending in parallel with the main scanning direction and normal to the sub-scanning direction, and one-half of the total number of blocks is mounted to the printhead in reserve orientation, relative to the other half of the blocks.

7. The ink jet printer according to claim 6, wherein the nozzle arrays of the same color are arranged such that their nozzles are offset from one another in the sub-scanning direction by an amount less than the dimension of the pixel in that direction.

* * * * *